US010367310B2

(12) United States Patent
Zhu et al.

(10) Patent No.: US 10,367,310 B2
(45) Date of Patent: Jul. 30, 2019

(54) CONNECTOR, MATCHED CONNECTOR AND CONNECTING ASSEMBLY

(71) Applicants: Tyco Electronics Technology (SIP) Co., Ltd., Suzhou (CN); TE Connectivity Corporation, Berwyn, PA (US)

(72) Inventors: Jianghua Zhu, Suzhou (CN); Weiping Zhao, Berwyn, PA (US)

(73) Assignees: Tyco Electronics Technology (SIP) Co., Ltd., Suzhou (CN); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/472,834

(22) Filed: Mar. 29, 2017

(65) Prior Publication Data

US 2017/0288344 A1 Oct. 5, 2017

(30) Foreign Application Priority Data

Mar. 29, 2016 (CN) ..... 2016 1 0186446

(51) Int. Cl.

| | |
|---|---|
| ***H01R 13/40*** | (2006.01) |
| ***H01R 13/6588*** | (2011.01) |
| ***H01R 13/631*** | (2006.01) |
| ***H01R 27/02*** | (2006.01) |
| ***H01R 13/50*** | (2006.01) |

(Continued)

(52) U.S. Cl.

CPC ..... *H01R 13/6588* (2013.01); *H01R 13/50* (2013.01); *H01R 13/631* (2013.01); *H01R 27/02* (2013.01); *H01R 13/4223* (2013.01); *H01R 13/6658* (2013.01)

(58) Field of Classification Search

CPC ..... H01R 13/639; H01R 13/4223; H01R 23/7073; H01R 13/4362; H01R 2101/00

USPC ..... 439/347, 595, 660, 752, 871

See application file for complete search history.

(56) References Cited

U.S. PATENT DOCUMENTS 5,059,142 A * 10/1991 Ohta ..... H01R 13/4368 439/752

5,145,419 A * 9/1992 Yamanashi ..... H01R 13/4368 439/595

(Continued)

*Primary Examiner* — Thanh Tam T Le

(74) *Attorney, Agent, or Firm* — Faegre Baker Daniels LLP

(57) ABSTRACT

The invention discloses a connector, a connector, a matched connector, a matched connector and a connecting assembly. The connecting assembly includes the connector and the matched connector. A terminal fixing portion of the connector is provided with terminal accommodating cavities for accommodating connecting terminals. Separators for separating adjacent connecting terminals are disposed as protruding between the terminal accommodating cavities. The matched connector comprises insertion holes and isolating slots provided on a female end seat. The separators are inserted into the isolating slots. One end of the connecting terminal is disposed on the body of the connector, and the other end is held within the insertion hole and is connectable with a terminal connecting piece of the matched connector. The invention prevents connecting terminals from interfering with each other to provide a higher secure connection performance, while maintaining smaller spacing therebetween.

20 Claims, 20 Drawing Sheets

(51) Int. Cl.
*H01R 13/422* (2006.01)
*H01R 13/66* (2006.01)

(56) References Cited

U.S. PATENT DOCUMENTS

| | | | | | |
|---|---|---|---|---|---|
| 5,292,261 | A * | 3/1994 | Hirano | H01R 13/4368 | 439/595 |
| 5,989,066 | A * | 11/1999 | Cox | H01R 13/4365 | 439/595 |
| 6,692,301 | B2 * | 2/2004 | Okayasu | H01R 13/4368 | 439/587 |
| 7,114,997 | B2 * | 10/2006 | Sagawa | H01R 13/4365 | 439/752 |
| 7,488,220 | B2 * | 2/2009 | Suzuki | H01R 13/4362 | 439/686 |
| 7,578,709 | B2 * | 8/2009 | Daudin | H01R 13/4361 | 439/752 |
| 7,670,177 | B2 * | 3/2010 | Myer | H01R 13/4223 | 439/595 |
| 7,766,697 | B2 * | 8/2010 | Matsumura | H01R 13/4362 | 439/595 |
| 7,780,484 | B2 * | 8/2010 | Martin | H01R 13/4223 | 439/752 |
| 8,408,950 | B2 * | 4/2013 | Jeon | H01R 13/4365 | 439/595 |
| 2002/0168895 | A1 * | 11/2002 | Suzuki | H01R 13/4365 | 439/595 |

* cited by examiner

CONNECTOR, MATCHED CONNECTOR AND CONNECTING ASSEMBLY

CLAIM OF PRIORITY

The present application claims priority from Chinese Patent Application Number 201610186446.7 filed Mar. 29, 2016, the subject matter of which is incorporated herein by reference.

TECHNICAL FILED

The present invention relates generally to an electrical connection structure, and particularly relates to a connector, a matched connector and a connecting assembly.

BACKGROUND

Connecting pieces are generally used for connecting in the existing technology in order to achieve stable electrical connection between different electronic devices, wires or connecting terminals. With the development of integration and large scale of electronic devices, a plurality of electronic devices, wires or connecting terminals often need to be simultaneously connected. Particularly, when a plurality of connecting terminals are connected, interference such as point discharge is easily produced between the connecting terminals spaced in a short distance, thus causing potential safety hazards.

SUMMARY OF THE INVENTION

One of the objects of the present invention is to overcome the shortcomings in the prior art. Thus a connecting piece, a connector, a matched connecting piece, a matched connector and a connecting assembly which are compact in structure, safe and stable are provided in the present invention.

The present invention achieves the above object by the following technical solutions.

The present invention provides a connecting piece. The connecting piece includes a body including a terminal fixing portion which is provided with a plurality of terminal accommodating cavities in a penetrating mode and separators arranged on the body and positioned between the adjacent terminal accommodating cavities. The separators extend reversely in the extension direction of the terminal accommodating cavities to separate the connecting terminals on the two sides of each separator.

Preferably, the body includes enclosure walls which continuously extend from the terminal fixing portion in the axial direction of the terminal accommodating cavities, and the separators are spaced from the enclosure walls.

Preferably, the body is provided with enclosure walls which continuously extend from the terminal fixing portion in the axial direction of the connecting piece, and the lengths of the enclosure walls extending along the extension directions of the terminal accommodating cavities are greater than the extension lengths of the separators.

Preferably, each enclosure wall is provided with a buckle matching portion used for buckling and matching a buckle on an external housing.

Preferably, the terminal accommodating cavities are arranged in two rows, each row of which includes a plurality of terminal accommodating cavities, and the separators are arranged between all the adjacent terminal accommodating cavities.

Preferably, the separators include a transverse separator and longitudinal separators, and the transverse separator is arranged between one row of terminal accommodating cavities and the other row of terminal accommodating cavities and the longitudinal separators are arranged on two sides of each terminal accommodating cavity in each row.

Preferably, all the longitudinal separators are connected with the transverse separator.

Preferably, the separators are integrated pieces.

Preferably, the connecting piece is an integrated injection molding piece.

Preferably, the terminal accommodating cavities include first accommodating cavities for accommodating low-voltage connecting terminals and second accommodating cavities for accommodating high-voltage connecting terminals.

Preferably, the first accommodating cavities and the second accommodating cavities have the same dimension, shape and structure.

Preferably, the separator is arranged between at least two adjacent second accommodating cavities.

Preferably, the separators are merely arranged between all the adjacent second accommodating cavities.

The present invention further provides a connector. The connector includes connecting terminals and the aforesaid connecting piece, and the connecting terminals are accommodated in the terminal accommodating cavities.

Preferably, at least part of the connecting terminals extend out of the terminal accommodating cavities from the front end of the terminal fixing portion, and the lengths of the connecting terminals extending out of the terminal accommodating cavities are smaller than the extension lengths of the adjacent separators.

Preferably, the body is provided with enclosure walls which continuously extend in the axial direction of the terminal accommodating cavities from the front end of the terminal fixing portion, and the extension lengths of the enclosure walls are greater than the lengths of the connecting terminals extending out of the terminal accommodating cavities.

Preferably, the connector further includes first secondary locks provided on the body, and each first secondary lock is provided with a blocking portion which is in blocking fit with the connecting terminal.

Preferably, each connecting terminal is provided with a terminal body and an insertion end is arranged on the terminal body. The terminal body has a radial dimension greater than that of the insertion end and is provided with a front end portion and a rear end portion in the insertion direction of the connecting terminal. The front end portion of the terminal body is in blocking fit with the blocking portion.

Preferably, a first barb is provided in each terminal accommodating cavity, and the first barbs are in blocking fit with the rear end portions of the terminal bodies.

Preferably, the connecting terminals are in interference fit with the walls of the corresponding terminal accommodating cavities.

Preferably, the connecting terminals and the body are formed as an integrated piece.

Preferably, two ends of the connecting terminals extend out of the terminal accommodating cavity respectively.

Preferably, the connector further includes a circuit board, and one end of each connecting terminal is connected to a matched terminal of a matched connector and the other end is connected to the circuit board.

Preferably, the connecting terminals include low-voltage connecting terminals and high-voltage connecting terminals.

Preferably, the low-voltage connecting terminals and the high-voltage connecting terminals have the same dimension, shape and structure.

Preferably, the terminal accommodating cavities include first accommodating cavities and second accommodating cavities, and the low-voltage connecting terminals are accommodated in the first accommodating cavities and the high-voltage connecting terminals are accommodated in the second accommodating cavities.

The present invention further provides a matched connecting piece. The matched connecting piece includes a female end seat which is provided with insertion holes and isolating slots. The insertion holes are formed in the axial direction of the female end seat in a penetrating mode and are used for accommodating the connecting terminals on the matched connecting piece. The isolating slots are arranged between the insertion holes to accommodate the separators on the matched connecting piece.

Preferably, the isolating slots are arranged in two rows and each row includes a plurality of isolating slots. The insertion holes are arranged between all the adjacent isolating slots.

Preferably, all the isolating slots are configured to be in communication with each other.

Preferably, the matched connecting piece is an injection molding piece.

Preferably, each insertion hole is provided with a front opening and a rear opening in the axial direction thereof. The wall of the insertion hole at the front end thereof is provided with an installation gap which is in communication with the front opening. The front opening is used for accommodating a connecting terminal on the matched connector.

The present invention further provides a matched connector. The matched connector includes the matched connecting piece and terminal connecting pieces as described in claims. The terminal connecting pieces are inserted into the insertion holes.

Preferably, the matched connector further includes second secondary locks and each second secondary lock is provided with a stop portion. Each terminal connecting piece is provided with a stopping front portion. The stop portion is at least partially in blocking fit with the stopping front portion of the terminal connecting piece.

Preferably, each insertion hole is provided with a front opening and a rear opening in the axial direction thereof. The wall of the insertion hole at the front end thereof is provided with an installation gap which is in communication with the front opening. The front opening is used for accommodating a connecting terminal on the matched connector. The terminal connecting piece is inserted from the rear opening, and the stop portion is accommodated in the installation gap.

Preferably, a second barb is provided in each insertion hole, and each terminal connecting piece is provided with a blocking matching portion protruding along the terminal connecting piece. The second barb is in blocking fit with the blocking matching portion of the terminal connecting piece.

The present invention further provides a connecting assembly. The connecting assembly includes the aforesaid connecting piece and the matched connecting piece as described in claims. The separators are accommodated in the isolating slots.

Preferably, the connecting assembly further includes connecting terminals. One end of each connecting terminal is arranged on the body and the other end is inserted into the insertion hole.

Preferably, the connecting assembly further includes a circuit board, and one end of each connecting terminal is connected to the circuit board.

Preferably, the connecting assembly further includes terminal connecting pieces, and each terminal connecting piece is accommodated in the insertion hole and connected with the other end of the connecting terminal.

Compared with the prior art, the connecting pieces of the present invention are provided with separators disposed on the bodies so that the connecting terminals inserted into the terminal accommodating cavities on the bodies are separated, which improves the safe connection performance, enables all the connecting terminals to keep smaller spacing on the premise of no mutual interference, and enables the connecting pieces to be compact in overall structure and the installation space to be saved.

Preferably, by means of matching between the transverse separators and the longitudinal separators, the separators of the connecting pieces not only improve the safety performance of the connecting pieces including a plurality of connecting terminals, but also provide larger accommodating space for installing the connecting terminals with different specifications. The connecting pieces achieve a quick and convenient insertion, provide different connection manners, and can be matched with the matched connecting pieces to meet different connection requirements.

DETAILED DESCRIPTION OF EMBODIMENTS

The present invention will be described in detail below in combination with the accompanying drawings.

Embodiment I

Figure 1:
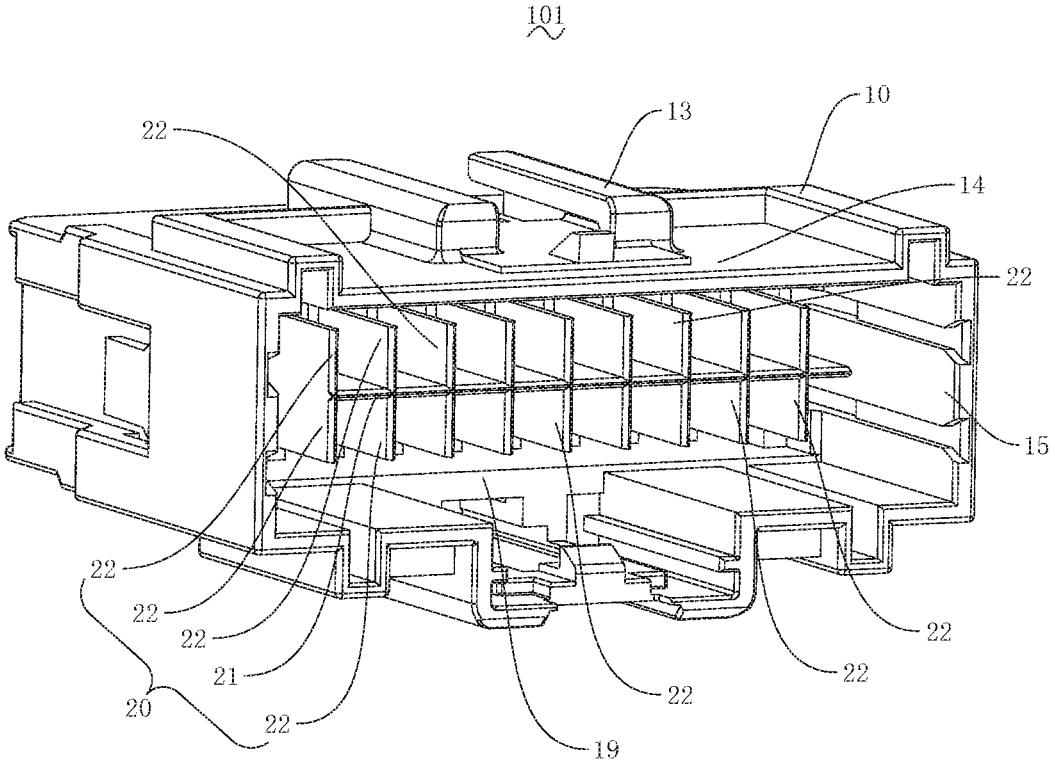
FIG. 1 is a structural schematic diagram I of one embodiment of a connecting piece provided by the present invention.
Figure 2:
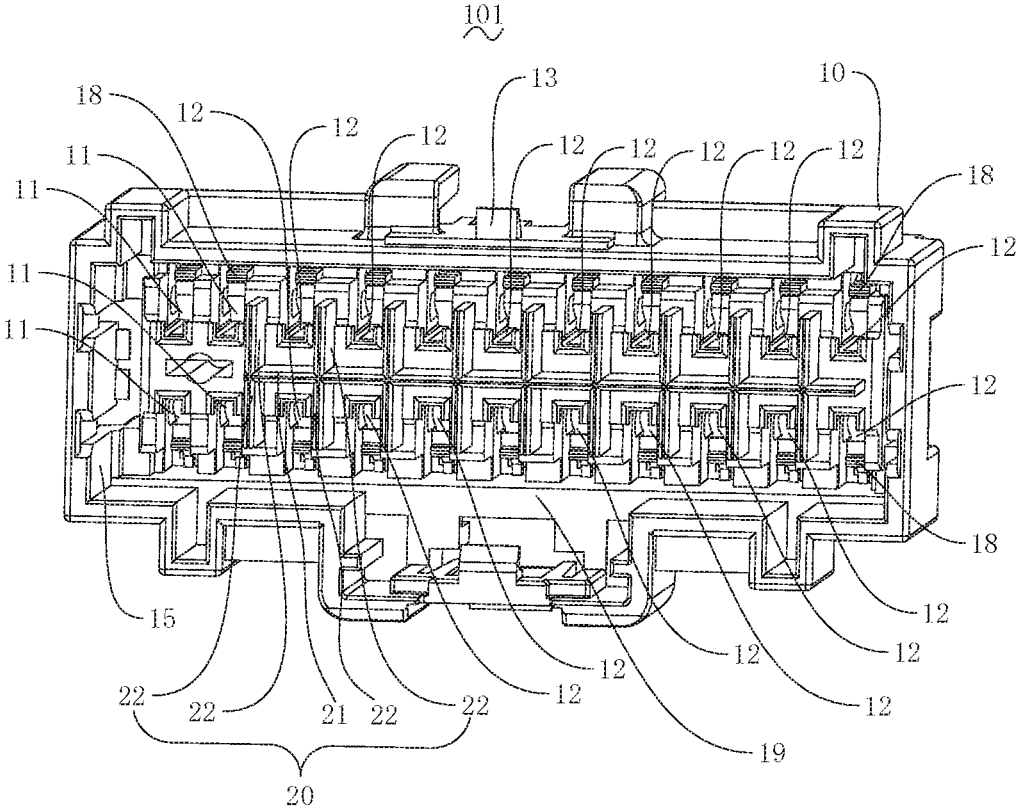
FIG. 2 is a structural schematic diagram II of the connecting piece in FIG. 1.
Figure 3:
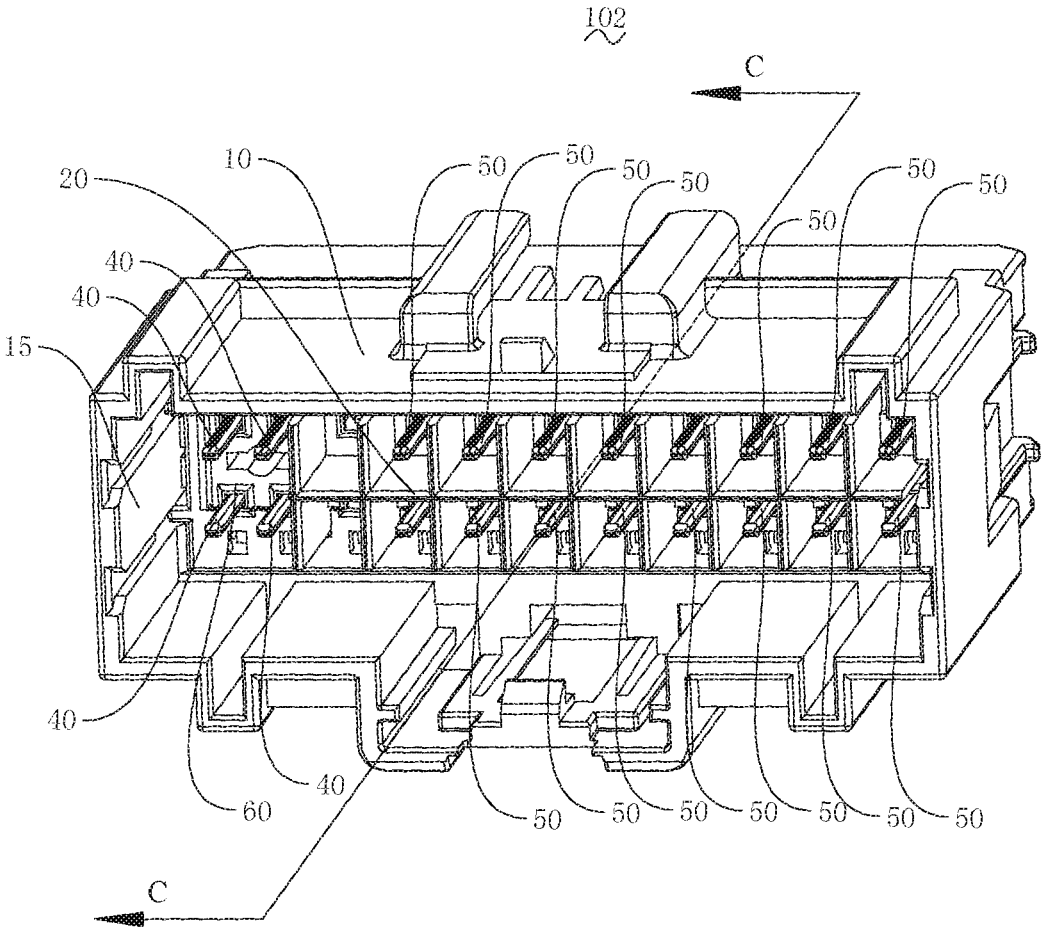
FIG. 3 is a structural schematic diagram I of a connector provided by the present invention.
Figure 4:
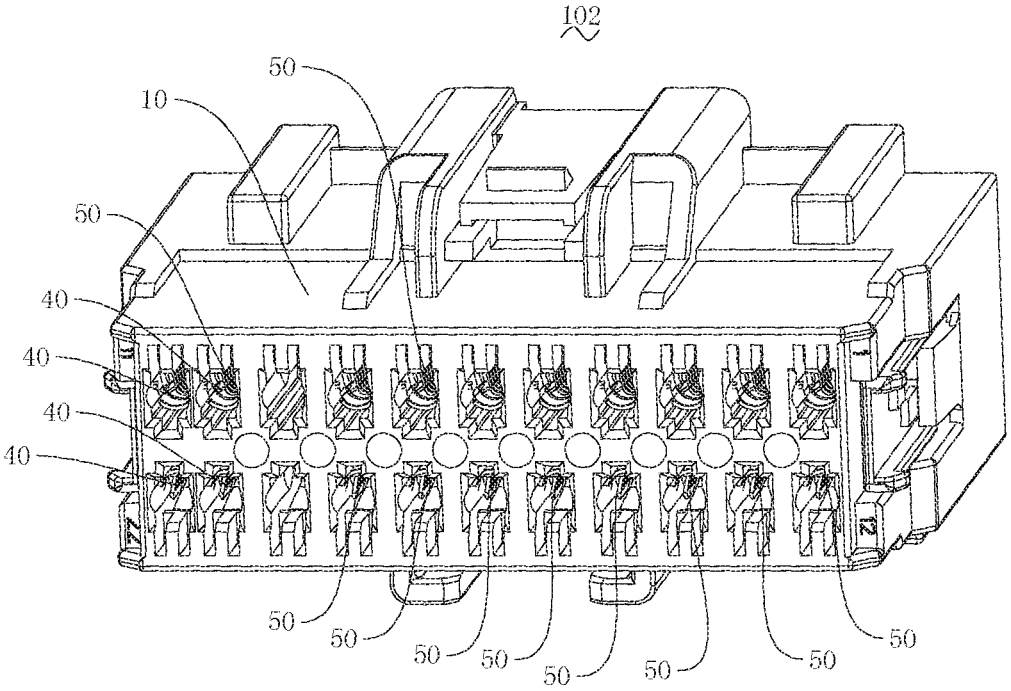
FIG. 4 is a structural schematic diagram II of the connector in FIG. 3.
Figure 5:
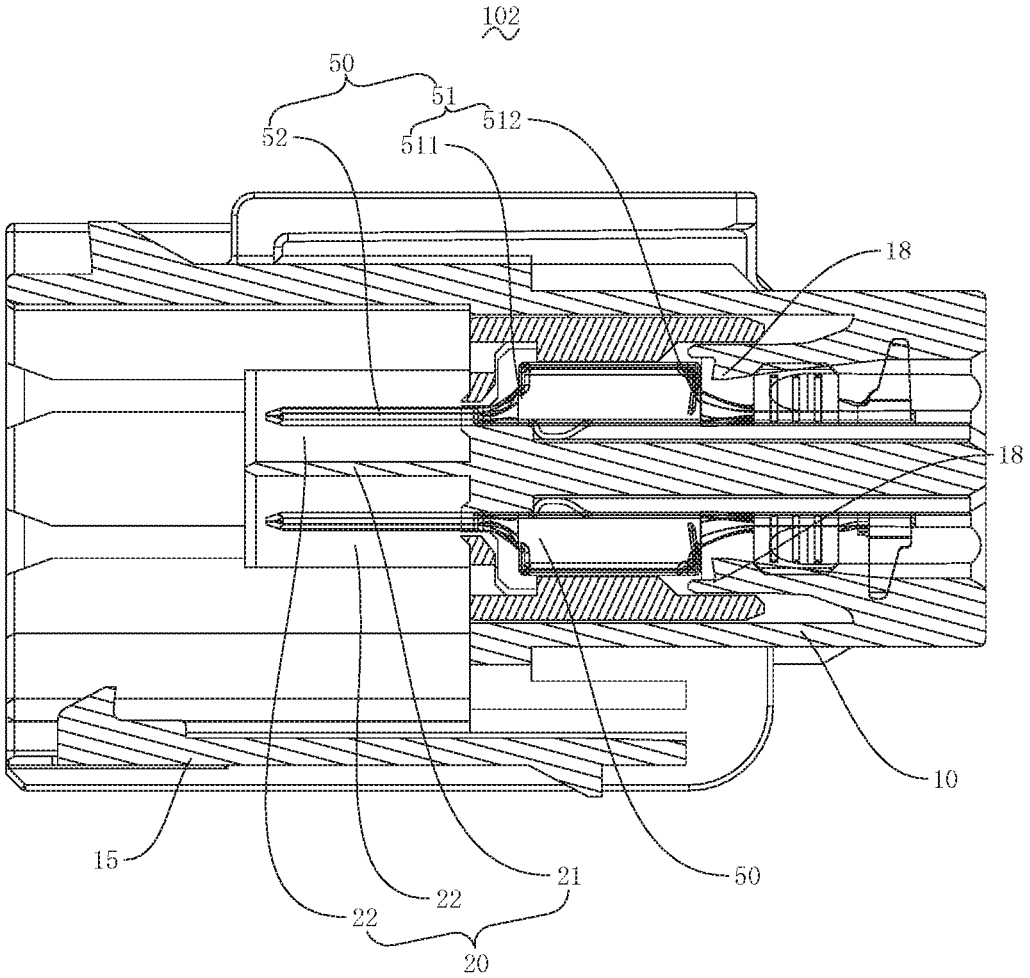
FIG. 5 is a section view of the connector in FIG. 3 along the line C-C.
Figure 6:
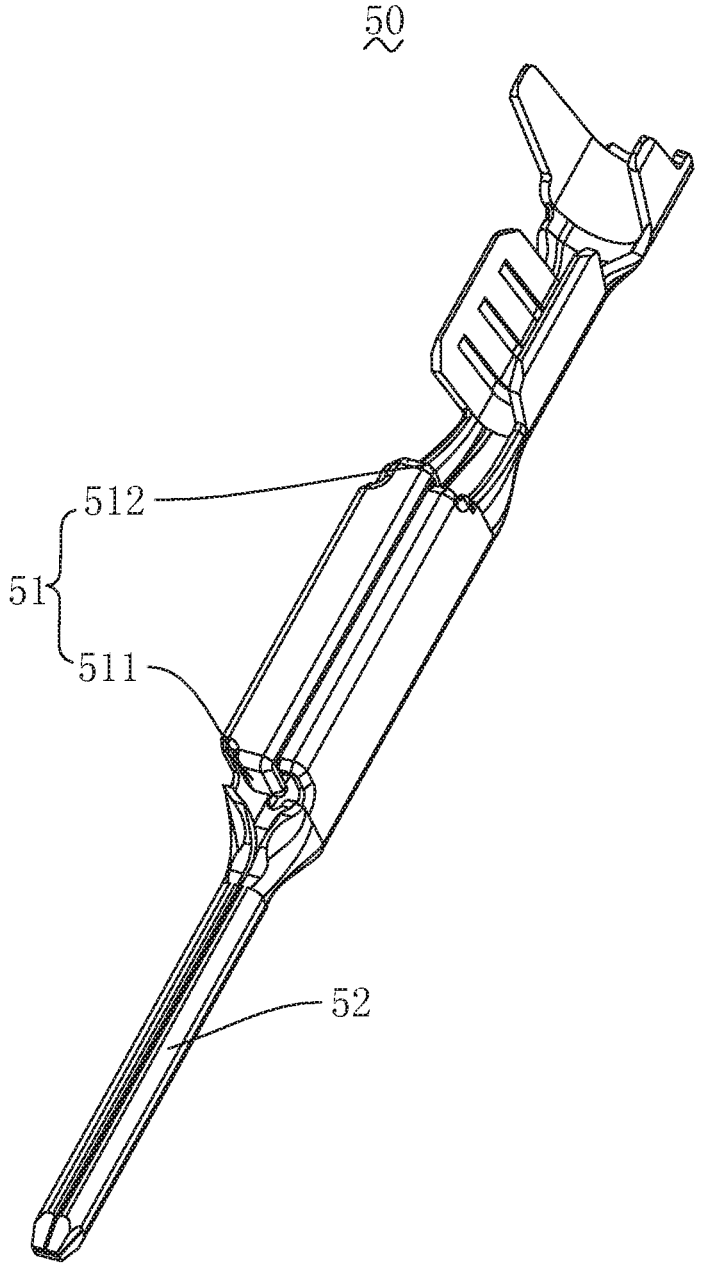
FIG. 6 is a structural schematic diagram of a high-voltage connecting terminal of the connector in FIG. 3.

Please refer to FIG. 1 and FIG. 2, which show a connecting piece 101 provided by the present invention. The connecting piece 101 includes a body 10 and separators 20.

The body 10 may be an integrated piece made of an insulating material, e.g. an injection molding piece. The shape, dimension and specification of the body 10 are selectable according to the installation requirement and a matched connecting terminal. In this embodiment, the body 10 is generally of a cuboid shape. The body 10 includes a terminal fixing portion 19. The terminal fixing portion 19 is provided with a plurality of terminal accommodating cavities (11, 12) in a penetrating mode. The plurality of terminal accommodating cavities (11, 12) are used for accommodating connecting terminals (40, 50) as described below. The terminal fixing portion 19 may be configured to be plate-like. The body 10 is provided with side walls 14. The side walls 14 are arranged around the terminal fixing portion 19.

In this embodiment, the terminal accommodating cavities include first accommodating cavities 11 and second accommodating cavities 12. The first accommodating cavity 11 is used for accommodating a low-voltage connecting terminal 40 as described below. The second accommodating cavity 12 is used for accommodating a high-voltage connecting terminal 50 as described below. The first accommodating cavities 11 and the second accommodating cavities 12 are both formed in a penetrating mode, and also can be interpreted as through holes or tubular cavities, so that two ends can be connected via the corresponding low-voltage connecting terminals 40 and high-voltage connecting terminals 50. The shape and dimension of the first accommodating cavity 11 can be available as long as they meet the requirement for accommodating the low-voltage connecting terminal 40. In this embodiment, the walls of the first accommodating cavity 11 at least partially abut against the low-voltage connecting terminals 40. The shape and dimension of the second accommodating cavity 12 can be available as long as they meet the requirement for accommodating the high-voltage connecting terminal 50. In this embodiment, the walls of the second accommodating cavity 12 at least partially abut against the high-voltage connecting terminal 50. The shapes, dimensions and structures of the first accommodating cavity 11 may be the same or different as those of the second accommodating cavity 12 on the premise that the requirements for accommodating the corresponding low-voltage connecting terminal 40 and high-voltage connecting terminal 50 are met.

It should be appreciated that, in this embodiment, the shape, dimension and structure of the first accommodating cavity 11 are the same as those of the second accommodating cavity 12, that is, the mechanical structure of the first accommodating cavity 11 is the same as that of the second accommodating cavity 12. But to distinguish the different effects that the first accommodating cavity 11 and the second accommodating cavity 12 have when they are respectively in installation fit with the low-voltage connecting terminal 40 and the high-voltage connecting terminal 50 to accordingly connect a low-voltage line and a high-voltage line, different names are used to indicate them.

The quantities of the first accommodating cavities 11 and the second accommodating cavities 12 are selectable according to the connection requirement and the quantities of the corresponding low-voltage connecting terminals 40 and high-voltage connecting terminals 50. In this embodiment, the quantity of the first accommodating cavities 11 is four. The quantity of the second accommodating cavities 12 is eighteen. The relative arrangement relationship of the first accommodating cavities 11 and the second accommodating cavities 12 can be selected according to the installation space and the connection requirement. In this embodiment, the first accommodating cavities 11 and the second accommodating cavities 12 are divided into two rows. Each row includes two first accommodating cavities 11 and nine second accommodating cavities 12. The first accommodating cavities 11 and the second accommodating cavities 12 in one row are exactly opposite to those in the other row in a one-to-one correspondence mode. That is, the two rows of first accommodating cavities 11 and second accommodating cavities 12 are parallel and exactly opposite.

In order to achieve better protective performance, in this embodiment, the body 10 is provided with enclosure walls 15. The enclosure walls 15 enclose all of the first accommodating cavities 11 and the second accommodating cavities 12. The enclosure walls 15 are configured to be spaced from the separators 20, so that the matched connecting piece has a larger installation space or has a larger space for matching with other structures. The enclosure walls 15 have greater extension lengths in the axial direction of the second accommodating cavities 12 than those of the separators 20, that is, the protruding heights of the enclosure walls 15 relative to the transverse planes of the openings of the second accommodating cavities 12 are greater than the protruding heights of the separators 20 relative to the transverse planes of the openings of the second accommodating cavities 12. The enclosure walls 15 are arranged around all of the first accommodating cavities 11 and the second accommodating cavities 12. The enclosure walls 15 are connected with the side walls 14 to form an accommodating cavity (not shown in the figures) matched with a matched connecting piece. The inner side walls of the enclosure walls 15 may be in contact with the matched connecting piece to form installation fit.

In order to facilitate close fit with a female end connecting structure, in this embodiment, each enclosure wall 15 is provided with a buckle matching portion 13 in a protruding mode, and the buckle matching portions 13 are used for buckling and matching buckles on a matched housing. The buckle matching portions 13 may be of installation matching structures such as clamping grooves, through holes and the like.

The separators 20 are arranged on the body 10 and positioned between the adjacent terminal accommodating cavities (11, 12). The separators 20 extend reversely in the extension direction of the terminal accommodating cavities (11, 12) to separate the connecting terminals (40, 50) at the two sides of the separators 20. The separators 20 may prevent the charged low-voltage connecting terminals 40 and high-voltage connecting terminals 50 from breaking down air. The breakdown air may lead to one high-voltage connecting terminal 50 is electrically conducted with another high-voltage connecting terminal 50 and one high-voltage connecting terminal 50 is electrically conducted with one low-voltage connecting terminal 40. Particularly, the insertion ends of the low-voltage connecting terminals 40 and the high-voltage connecting terminals 50 are generally sharp, thus causing point discharge, which can be avoided by using the separators 20. The separators 20 may be made of a material meeting the requirement for blocking point discharge, e.g. rubber and boards. In this embodiment, the separators 20 are made of plastic, that is, the separator 20 has a plastic structure. The shape and the dimension of the separators 20 can be acceptable as long as they meet the requirement for blocking point discharge. The separators 20 may be lugs or bosses. In this embodiment, the separators 20 are flat in order to reduce the occupied space as much as possible. The extension lengths of the separators 20 are greater than or equal to the lengths of the corresponding high-voltage connecting terminals 50 protruding out of the second accommodating cavities 12, thus avoiding point discharge that may be generated by high-voltage connecting terminals 50. The separators 20 are arranged on the body 10 and positioned between at least two second accommodating cavities 12. The separators 20 extend in the axial direction of the second accommodating cavities 12, so as to prevent the high-voltage connecting terminals at the two sides of the separators 20 from breaking down air.

It could be contemplated that, the probability of the air breakdown generated between one high-voltage conductor and one low-voltage conductor is smaller than that between one high-voltage conductor and another high-voltage conductor on the premise of equal spacing. Thus, the separators 20 may be merely arranged between all the adjacent second accommodating cavities 12. In this embodiment, in order to avoid the problem that the high-voltage connecting terminals 50 and the low-voltage connecting terminals 40 are electrically conducted due to the air breakdown generated therebetween, a plurality of separators 20 are provided and a part of the separators 20 are arranged between the first accommodating cavities 11 and the second accommodating cavities 12.

As mentioned above, in this embodiment, the second accommodating cavities 12 are arranged in two rows. Each row includes a plurality of second accommodating cavities 12. The separators 20 are arranged between the adjacent second accommodating cavities 12. In this embodiment, the separators 20 include a transverse separator 21 and longitudinal separators 22. The transverse separator 21 is arranged between one row of second accommodating cavities 12 and the other row of second accommodating cavities 12. The longitudinal separators 22 are arranged at two sides of each second accommodating cavity 12 in each row. The above implementation manner of the separators 20 enables three sides of each second accommodating cavity 12 to be enclosed, so that not only can the safety performance of preventing the point discharge of the high-voltage connecting terminals 50 be obtained, but also devices or conductors connected and matched with the high-voltage connecting terminals 50 accommodated in the second accommodating cavities 12 have a larger installation space because the fourth side of each second accommodating cavities 12 is open (i.e., in an elongated shape of straight slot).

In order to obtain better shielding performance to better prevent point discharge, the second accommodating cavities 12 are shorter in the spaced distance therebetween and more compact in structures. In this embodiment, all the longitudinal separators 22 are connected with the transverse separator 21. That is, in this embodiment, the separators 22 are configured to form a plurality of cross grids connected transversely.

In order to facilitate assembly and improve the stable connection performance, the connecting piece 101 is an integrated piece in this embodiment. In order to reduce the manufacturing cost on the premise of better preventing point discharge, the connecting piece 101 is an injection molding piece in this embodiment.

Embodiment II

Please refer to FIG. 3 to FIG. 6, which show structural schematic diagrams of a connector 102 provided by the present invention. The connector 102 includes the connecting piece 101 of embodiment I and connecting terminals (40, 50).

In this embodiment, the connecting terminals include low-voltage connecting terminals 40 and high-voltage connecting terminals 50. In order to achieve a better blocking effect to improve the protective performance on the premise of facilitating realization of corresponding connection functions, the connecting terminals (40, 50) extend out of the terminal accommodating cavities (11, 12) from the front end of the terminal fixing portion 19, and the lengths of the connecting terminals (40, 50) extending out of the terminal accommodating cavities (11, 12) are smaller than the extension lengths of the adjacent separators 20.

The low-voltage connecting terminals 40 are accommodated in the first accommodating cavities 11. The high-voltage connecting terminals 50 are accommodated in the second accommodating cavities 12. In this embodiment, the low-voltage connecting terminals 40 extend in the insertion direction thereof to extend out of the first accommodating cavities 11, and the lengths of the low-voltage connecting terminals 40 extending out of the first accommodating cavities 11 are smaller than or equal to the extension lengths of the separators 20. Of course, the low-voltage connecting terminals 40 may be accommodated in the first accommodating cavities 11 but do not extend out of the first accommodating cavities 11. At the moment, electronic devices or wires matched with the low-voltage connecting terminals 40 may enter the first accommodating cavities 11 by extending, so as to realize connection of low-voltage lines with the low-voltage connecting terminals 40. Accordingly, the separators 20 can also prevent the low-voltage connecting terminals 40, the electronic devices or the wires from discharging.

The high-voltage connecting terminals 50 extend in the insertion direction thereof to extends out of the second accommodating cavities 12, and the lengths of the high-voltage connecting terminals 50 extending out of the second accommodating cavities 12 are smaller than or equal to the extension lengths of the separators 20. Of course, the high-voltage connecting terminals 50 may be accommodated in the second accommodating cavities 12 but do not extend out of the second accommodating cavities 12. At the moment, electronic devices or wires matched with the high-voltage connecting terminals 50 may enter the second accommodating cavities 12 by extending, so as to realize connection of high-voltage lines with the high-voltage connecting terminals 50. Accordingly, the separators 20 can also prevent the high-voltage connecting terminals 50, the electronic devices or the wires from discharging.

According to the corresponding connection requirements, the low-voltage connecting terminals 40 and the high-voltage connecting terminals 50 may adopt the same structure or different structures. In order to reduce the manufacturing cost and improve the installation efficiency, the low-voltage connecting terminals 40 and the high-voltage connecting terminals 50 have the same structure, dimension and shape in this embodiment. It should be noted that, the connecting terminals are named for distinguishing the different effects that the low-voltage connecting terminals 40 are connected to low-voltage lines while the high-voltage connecting terminals 50 are connected to high-voltage lines. In this embodiment, each high-voltage connecting terminal 50 includes a high-voltage body 51 and a high-voltage insertion end 52. The high-voltage body 51 has a radial dimension or cross section area greater than that of the high-voltage insertion end 52. The high-voltage bodies 51 are accommodated in the second accommodating cavities 12. The high-voltage insertion ends 52 extend out of the second accommodating cavities 12. The high-voltage bodies 51 can be in blocking fit with blocking portions 62 of the first secondary locks 60 as will be described below, so as to prevent the high-voltage connecting terminals 50 from moving.

In order to be stably arranged in the first accommodating cavity 11, each low-voltage terminal body 41 is provided with a low-voltage front end portion 411 and a low-voltage rear end portion 412 in the insertion direction of the low-voltage connecting terminal 40. The low-voltage front end portion 411 of the low-voltage terminal body 41 is matched with the blocking portion 62 in a blocking manner. In order to be stably arranged in the second accommodating cavity 12, each high-voltage terminal body 51 is provided with a high-voltage front end portion 511 and a high-voltage rear end portion 512 in the insertion direction of the high-voltage connecting terminal 50. The high-voltage front end portion 511 of the high-voltage terminal body 51 is matched with a blocking portion 62 in a blocking manner.

In order to further stably arrange each low-voltage connecting terminal in a first accommodating cavity 11, the first accommodating cavity 11 is provided with a first barb 18. The first barb 18 is in blocking fit with the low-voltage rear end portion 412 of the low-voltage terminal body 41. In order to further stably arrange each high-voltage connecting terminal in a second accommodating cavity 12, the second accommodating cavity 12 is provided with a first barb 18. The first barb 18 is in blocking fit with the high-voltage rear end portion 512 of the high-voltage terminal body 51.

In order to facilitate realizing preassembly of the low-voltage connecting terminals 40 and the high-voltage connecting terminals 50 and improve the stable installation performance of the corresponding low-voltage connecting terminals 40 and high-voltage connecting terminals 50, the connector 102 further includes first secondary locks 60. The first secondary locks 60 are preassembled on the body 10 through primary locks and in blocking fit with the high-voltage bodies 51 through final locks, thus limiting positions of the high-voltage connecting terminals 50. The first secondary locks 60 are provided with blocking portions 62 in one-to-one blocking fit with the high-voltage bodies 51 of the high-voltage connecting terminals 50 and the low-voltage bodies 41 of the low-voltage connecting terminals 40. The blocking portions 62 may be plate-like.

Embodiment III

Figure 7:
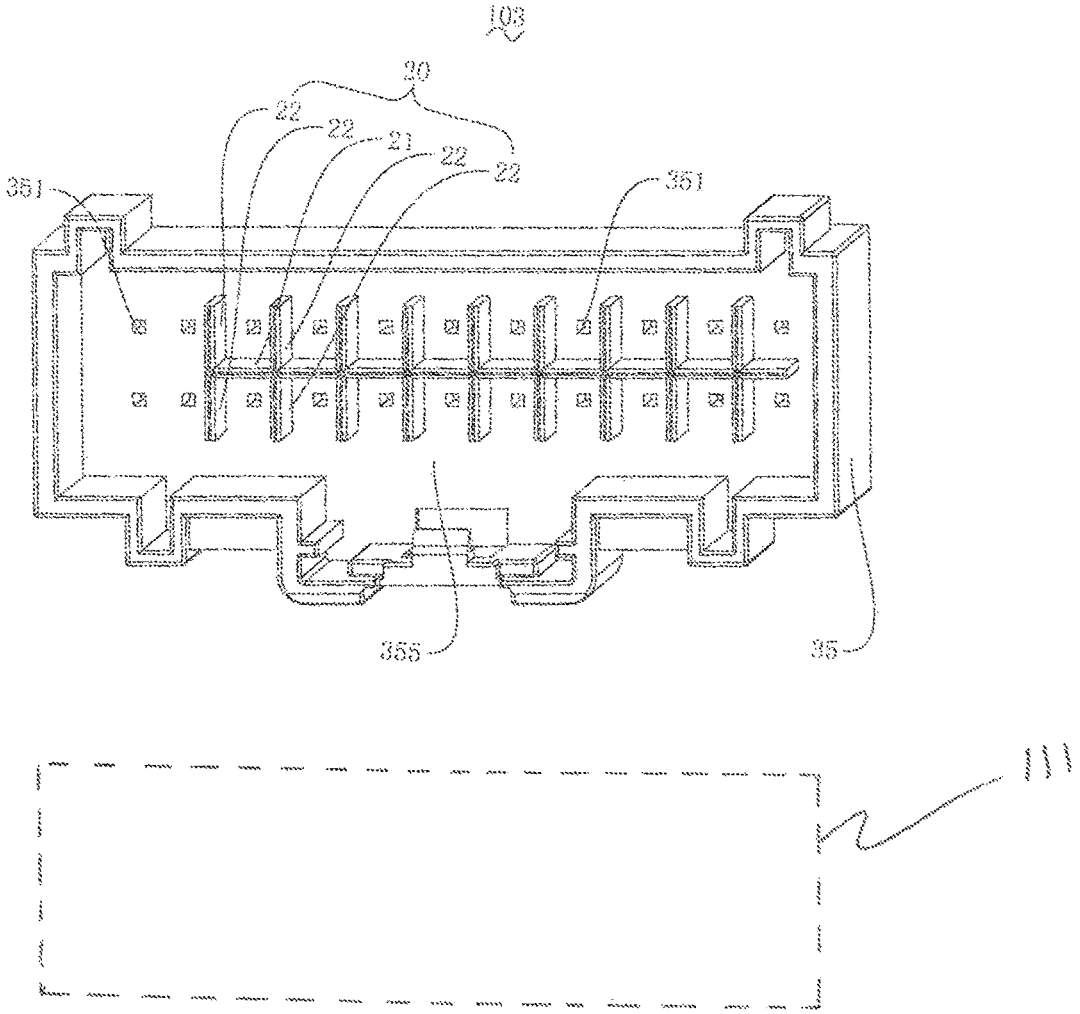
FIG. 7 is a structural schematic diagram of another embodiment of a connecting piece provided by the present invention.

Please refer to FIG. 7. As a variation of embodiment I, the present invention further provides a connecting piece 103. Embodiment III mainly differs from embodiment I in that: the supporting structure of the connecting piece 103 is different from that of the connecting piece 101 of embodiment I. The connecting piece 103 includes a body 35. Both the body 35 and the body 10 of the connecting piece 101 of embodiment I are used for bearing the separators 20.

The connecting terminals (40, 50, 71, 72) are in interference fit with the walls of the terminal accommodating cavities (11, 12). In this embodiment, the low-voltage connecting terminals 40 are in interference fit with the walls of the corresponding low-voltage terminal accommodating cavities 11. The high-voltage connecting terminals 50 are in interference fit with the walls of the corresponding high-voltage terminal accommodating cavities 12.

As another assembly mode, the connecting terminals (40, 50, 71, 72) and the body 35 are formed as an integrated piece in order to strengthen the stability and improve the assembly efficiency. For example, the connecting terminals (40, 50, 71, 72) and the body 35 may be formed into an integrated piece made from copper material. Further, two ends of the connecting terminals (40, 50) extend out of the terminal accommodating cavities (11, 12) respectively, so that the two ends of the connecting terminals (40, 50, 71, 72) can be connected with electronic devices or matched terminals respectively. For example, the two ends of the connecting terminals (40, 50, 71, 72) can be connected with a circuit board and terminal connecting pieces 88 respectively.

In order to improve the integration level of circuits for saving energy and improve the universal performance, a circuit board 111 (FIG. 7) is further included. One end of each of the connecting terminals (40, 50, 71, 72) is connected to a matched terminal of a matched connector 105, while the other end is connected to the circuit board. In this embodiment, the matched terminal may be the terminal connecting piece 88 as described below.

The body 35 includes an installation portion 355. The installation portion 355 is provided with a plurality of terminal accommodating cavities 351 in a penetrating mode. The terminal accommodating cavities 351 are used for accommodating connecting terminals of the following connector 104 or electronic devices on the circuit board. The terminal accommodating cavities 351 may also be divided into high-voltage terminal accommodating cavities and low-voltage terminal accommodating cavities, and the specific distribution and matching of the terminal accommodating cavities are described in the aforementioned embodiments and will not be redundantly described herein. The shape and the structure of the body 35 only need to meet the requirement for bearing the separators 20. In this embodiment, in order to achieve better sealing and protective performance, when the separators 20 are inserted into the body 35, the side wall of the body 35 is in sealing fit with a female end seat 210 as described below. Specifically, the body 35 is provided with an accommodating cavity for accommodating the separators 20. One end of the accommodating cavity is open, so that the separators 20 can be inserted into the corresponding body 35.

The male end connecting piece 102 is provided with the same separators 20 as those the connecting piece 101 is provided with. All the separators 20 are arranged on the body 35. In order to further improve the stability of the separators 20 on the body 35, the separators 20 and the body 35 are formed as an integrated piece. In this embodiment, in order to achieve better performance of preventing point discharge and reduce the manufacturing cost, the separators 20 and the body 35 are formed as an injection molding piece, that is, the separators 20 and the body 35 are made into an integrated piece by injection molding.

It should be noted that, the body 35 may be replaced with the body 10 in embodiment I. In embodiment II, the body 35 and the terminal accommodating cavities 351 are used for matching with electronic devices on a circuit board to form a male end connector. Because the circuit board and the electronic devices are regular and flat in structure, the installation portion 355 of the body 35 may be flat. According to different shapes and specifications of electronic devices or connecting terminals to be accommodated, it is not necessary for the terminal accommodating cavities 351 to be as complex as the terminal accommodating cavities (11, 12) in embodiment I, so that the manufacturing cost is reduced.

Embodiment IV

Figure 8:
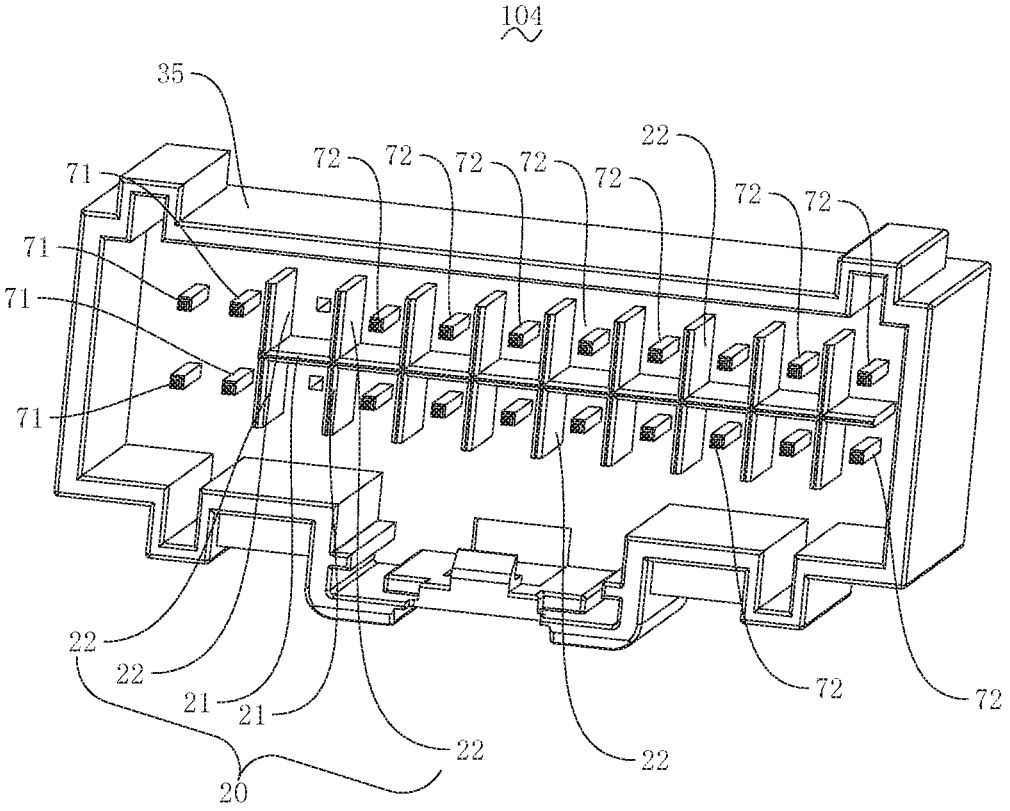
FIG. 8 is a structural schematic diagram of a connector of the connecting piece shown in FIG. 7 provided by the present invention.

Referring to FIG. 8, the present invention further provides a connector 104. The connector 104 includes the connecting piece 103 of embodiment III and connecting terminals (71, 72).

The connecting terminals (71, 72) may be replaced with the connecting terminals (40, 50) in embodiment I. In this embodiment, the connecting terminals (71, 72) are columnar. One end of each of the connecting terminals (71, 72) is arranged on a terminal accommodating cavity 351 of the body 35, and the other end is used to be connected with a matched connector.

In this embodiment, the connecting terminals (71, 72) include second low-voltage connecting terminals 71 and second high-voltage connecting terminals 72. Terminal connecting pieces 88 connected with the second low-voltage connecting terminals 71 may be connected with a low-voltage line. Terminal connecting pieces 88 connected with the second high-voltage connecting terminals 72 may be connected with a high-voltage line. Each of the terminal connecting pieces 88 has a maximum radial dimension greater than that of the second low-voltage connecting terminal 71 and the second high-voltage connecting terminal 72. The second low-voltage connecting terminals 71 are inserted into the first accommodating cavities 11. The second high-voltage connecting terminals 72 are inserted into the second accommodating cavities 12.

In this embodiment, the second low-voltage connecting terminals 71 are inserted into the first accommodating cavities 11 in the direction along which the separators 20 are inserted into the body 10. The second high-voltage connecting terminals 72 are inserted into the second accommodating cavities 12 in the direction along which the separators 20 are inserted into the body 10.

In order to conveniently insert the second low-voltage connecting terminals 71 and the second high-voltage connecting terminals 72 into the corresponding body 10, all the second low-voltage connecting terminals 71 and all the second high-voltage connecting terminals 72 are preferably arranged on the body 35. In this embodiment, the body 35 is provided with terminal accommodating cavities 351. One end of each of the second low-voltage connecting terminals 71 and the second high-voltage connecting terminals 72 is inserted into the corresponding terminal accommodating cavity 351, so that the second low-voltage connecting terminals and the second high-voltage connecting terminals can be respectively inserted into the corresponding first accommodating cavities 11 and second accommodating cavities 12 when the separators 20 are inserted into the body 10.

The second low-voltage connecting terminals 71 may be the same as or different from the first low-voltage connecting terminals 40 of embodiment III in structure. In this embodiment, the second low-voltage connecting terminals 71 and the first low-voltage connecting terminals 40 have different structures. The second low-voltage connecting terminal 71 has a roughly cuboid column structure. In this embodiment, the second high-voltage connecting terminals 72 and the second low-voltage connecting terminals 71 have the same structure and dimension.

Embodiment V

Embodiment V provides another implementation of the connector 104. In embodiment V, the connector 104 includes the connecting piece 103 of embodiment III and a circuit board (not shown in the figures). The circuit board is also referred to as a wiring board. Electronic devices (not shown in the figures) are arranged on the circuit board in a protruding mode. The circuit board may be arranged to be exactly opposite to one side of the installation portion 355 or attached to the outer bottom wall of the installation portion 355. The electronic devices on the circuit board penetrate through the terminal accommodating cavities 351 to be connected with the matched connector on the other side of the installation portion 355.

Embodiment VI

Figure 9:
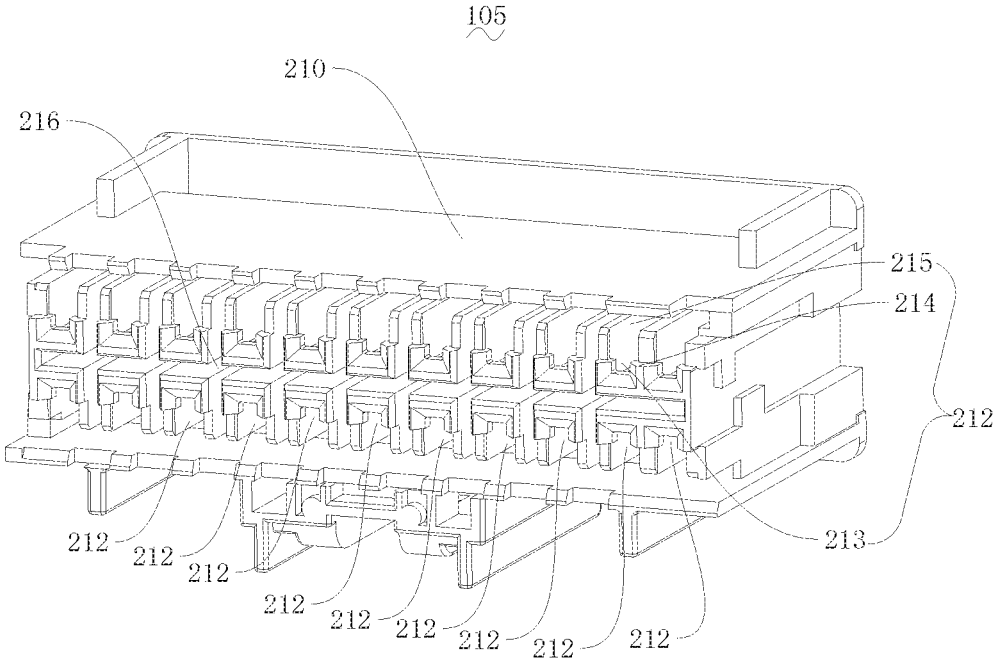
FIG. 9 is a structural schematic diagram I of a matched connecting piece provided by the present invention.
Figure 10:
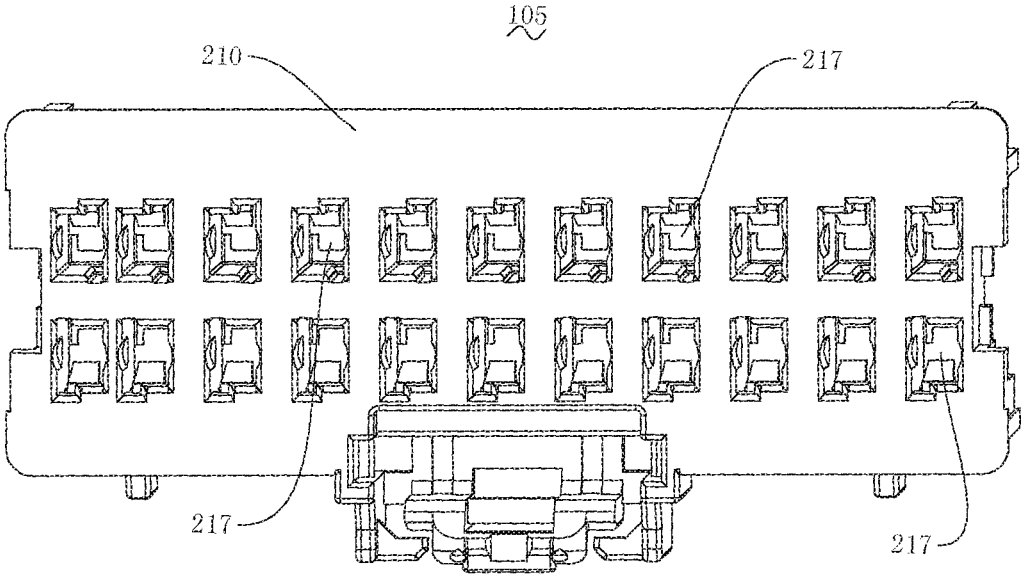
FIG. 10 is a structural schematic diagram II of the matched connecting piece in FIG. 9.
Figure 11:
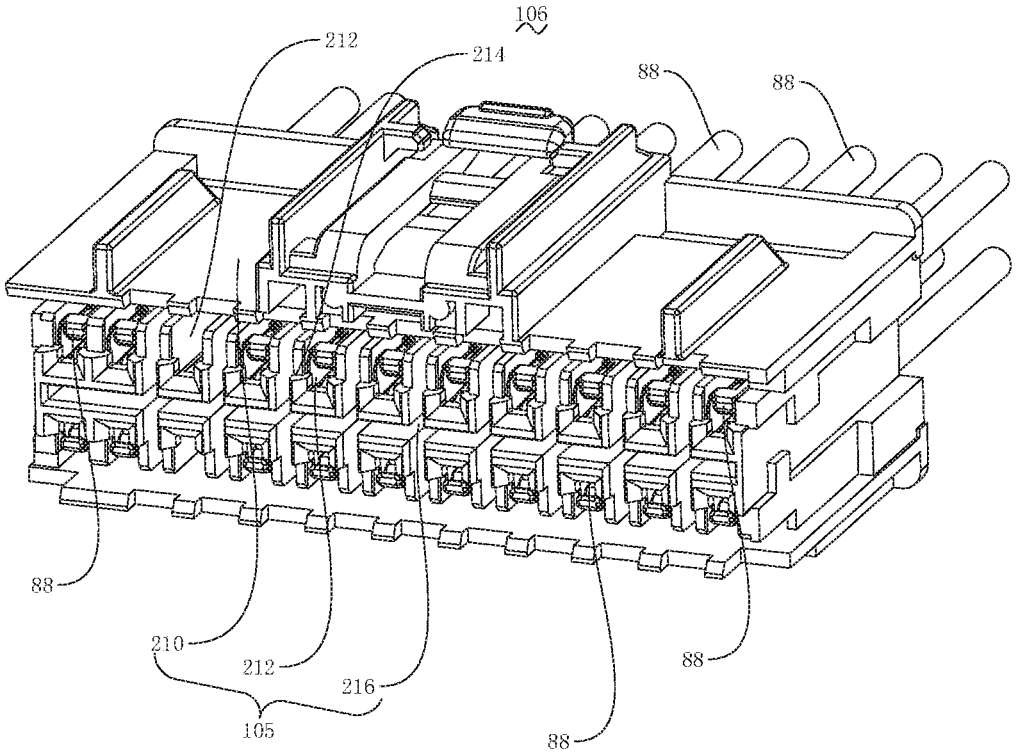
FIG. 11 is a structural schematic diagram of a matched connector provided by the present invention.
Figure 12:
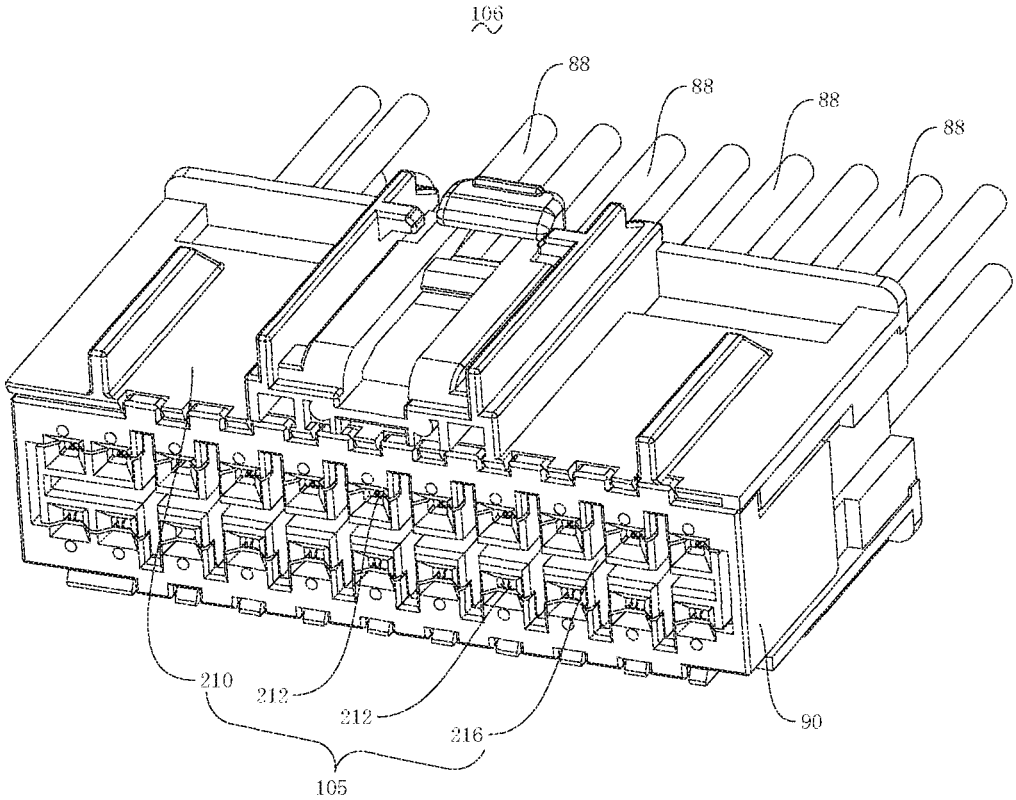
FIG. 12 is a structural schematic diagram I of the matched connector in FIG. 11 provided with second secondary locks.
Figure 13:
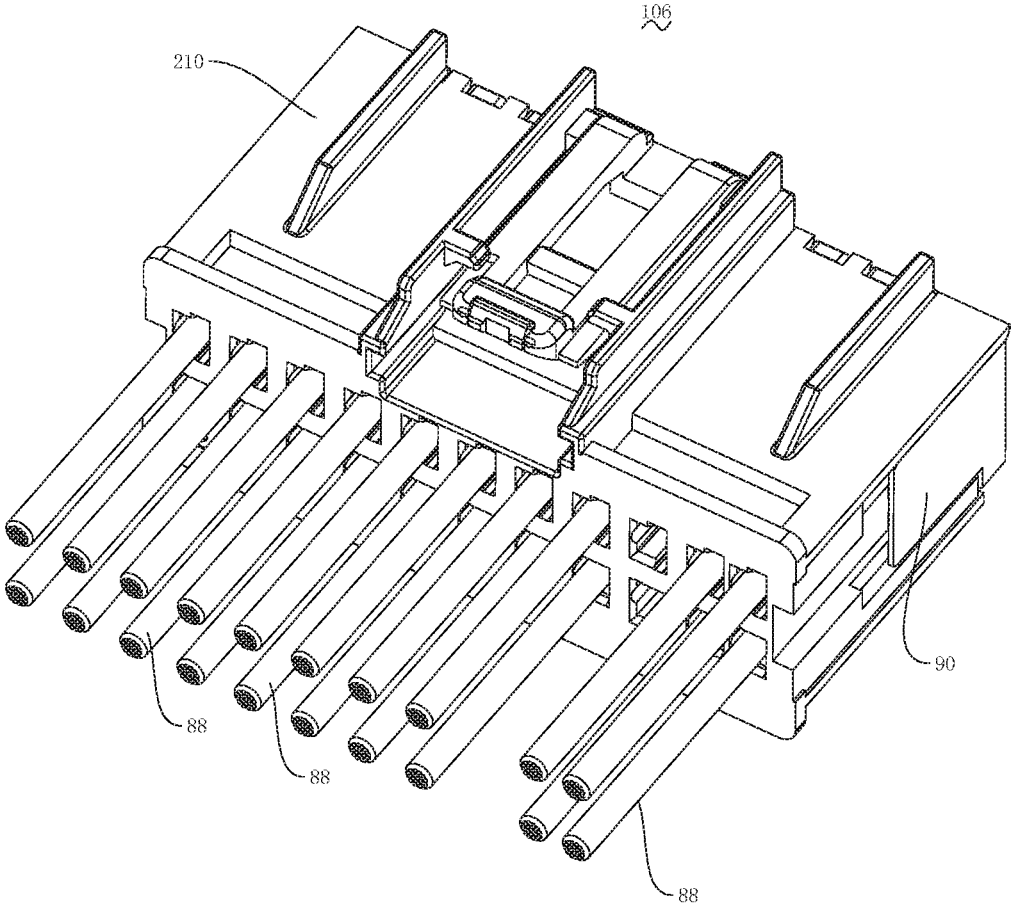
FIG. 13 is a structural schematic diagram II of the matched connector in FIG. 12.
Figure 14:
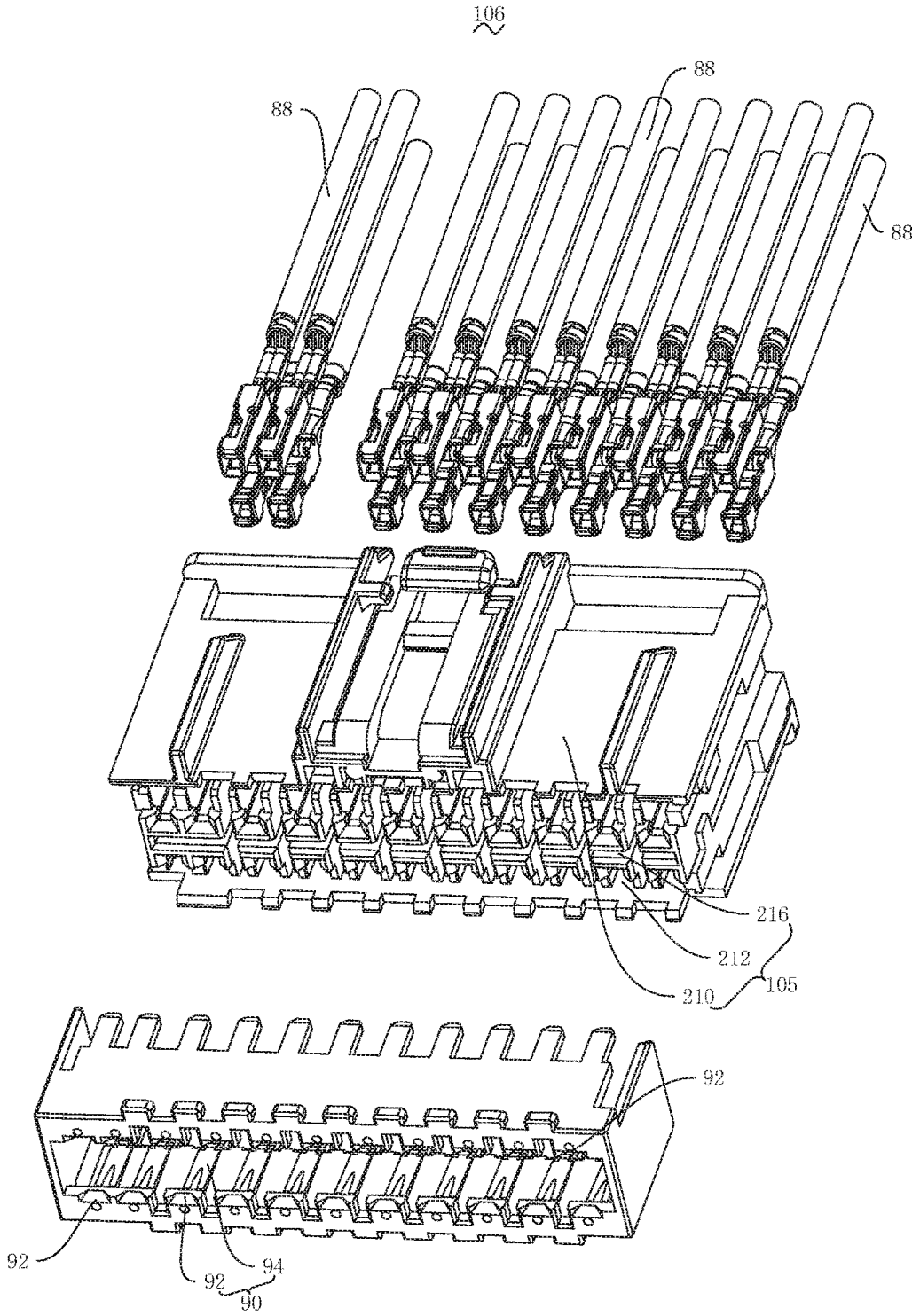
FIG. 14 is a perspective exploded view of the matched connector in FIG. 12.
Figure 15:
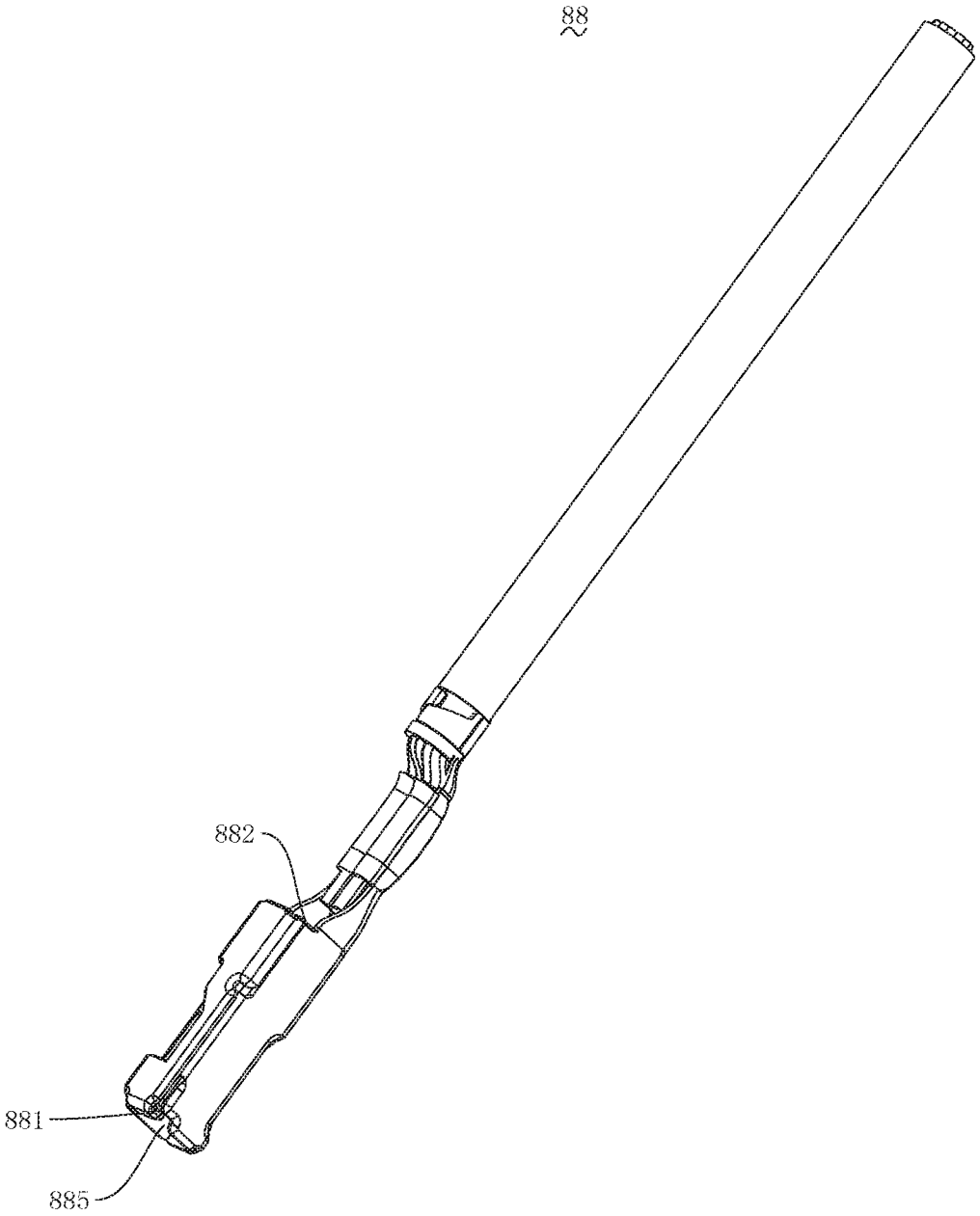
FIG. 15 is a structural schematic diagram of a terminal connecting piece of the matched connector in FIG. 11.
Figure 16:
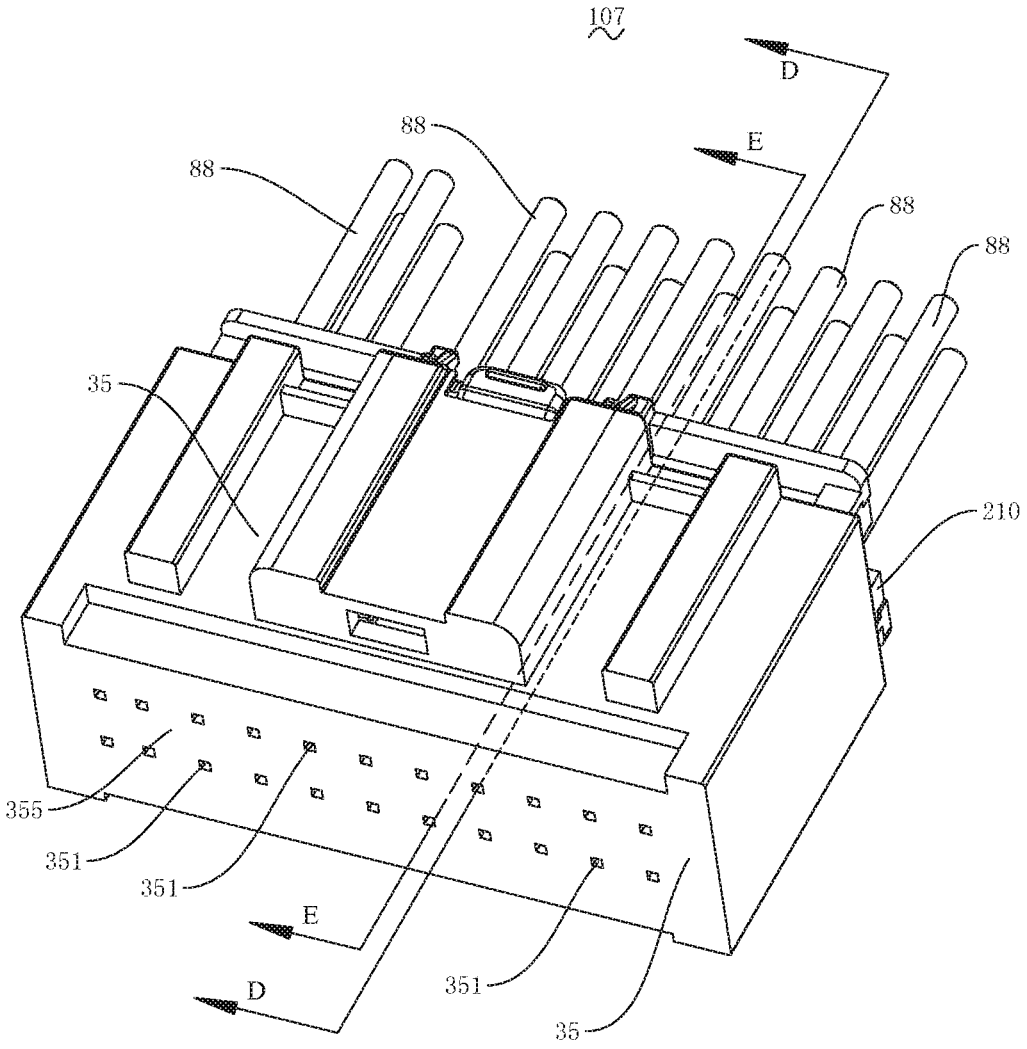
FIG. 16 is a structural schematic diagram of a connecting assembly provided by the present invention.

Please refer to FIG. 9 and FIG. 10, which show a matched connecting piece 105 provided by the present invention. The matched connecting piece 105 can be used for matching with the connecting piece 101 of embodiment I and the connecting piece 103 of embodiment III. The matched connecting piece 105 includes a female end seat 210. The female end seat 210 is provided with insertion holes 212 and isolating slots 216.

Each insertion hole 212 is formed in a penetrating mode in the axial direction of the female end seat 210 and is provided with a front opening 213, a rear opening 217, an installation gap 214 and a radial gap 215. In this embodiment, each insertion hole 212 is a through hole formed in a penetrating mode in the axial direction of the female end seat 210. The front openings 213 of the insertion holes 212 are used for accommodating the connecting terminals (71, 72) of the connector 104 or electronic devices, and the rear openings 217 of the insertion holes 212 are used for accommodating the terminal connecting pieces 88 as described below. The installation gaps 214 are communicated with the front openings 213 to accommodate stop portions 92 of the second secondary locks 90 as described below, so that the second secondary locks 90 can be arranged on the matched connecting piece 105 in a more flat and more space-saving mode. The radial gaps 215 are formed on the side walls of the insertion holes 212 at the front end thereof and are in communication with the installation gaps 214. The radial gaps 215 enable the insertion holes 212 to have a larger accommodating space so as to adapt to connecting terminals with larger dimension, thus having a higher universal performance.

The isolating slot 216 is formed between the insertion holes 212 to be used for inserting the separators 20 of the connecting piece 103. The arrangement relationship between the insertion holes 212 and the isolating slots 216 in this embodiment will be specifically described as follows: the insertion holes 212 are arranged in two rows, and each row includes a plurality of insertion holes 212; and the isolating slots 216 are formed between all the adjacent insertion holes 212. In order to save materials and facilitate insertion fit, all the isolating slots 216 are arranged in communication with each other.

In order to strengthen the stability, the matched connecting piece 105 may be made into an integrated piece by injection molding.

Embodiment VII

Please refer to FIGS. 11-15, which show a matched connector 106 provided by the present invention. The matched connector 106 includes the matched connecting piece 105 of embodiment VI and terminal connecting pieces 88.

The terminal connecting pieces 88 are inserted into the rear ends of the insertion holes 212 from the rear openings 217 and can be connected with the connecting terminals (71, 72) inserted into the insertion holes 212 from the front openings 213 or electronic devices. A plurality of terminal connecting pieces 88 can be convenient for connection with other devices and lines. The terminal connecting pieces 88 are inserted into the rear ends of the insertion holes 212 in the direction opposite to the direction in which the separators 20 are inserted into the corresponding body 10. Moreover, the terminal connecting pieces 88 are connected with the connecting terminals (71, 72) respectively. In order to achieve stable connection performance, each terminal connecting piece 88 is provided with an accommodating cavity 885. The connecting terminals (71, 72) are inserted into the corresponding accommodating cavities 885 to connect the terminal connecting pieces 88. The accommodating cavities 885 may be formed in the axial direction of the terminal connecting pieces 88 in a penetrating mode.

In this embodiment, to prevent the terminal connecting pieces 88 from loosening and obtain a stable connection performance, the matched connector 104 further includes second secondary locks 90. Each second secondary lock 90 is provided with a stop portion 92. The stop portions 92 are partially in blocking fit with the ends of the terminal connecting pieces 88. The stop portions 92 may be plate-like. Each second secondary lock 90 further includes a cover plate 94. The cover plates 94 are connected with the stop portions 92 and extend in the axial direction of the insertion holes 212, and the cover plates 94 cover the installation gaps of the insertion holes 212. The cover plates 94 can provide sufficient isolation for the connecting terminals (71, 72) to avoid interference with the outside or electric shock or the like.

The stable arrangement manner of the terminal connecting pieces 88 in this embodiment will be specifically described as follows: each terminal connecting piece 88 is provided with a stopping front portion 881 and a blocking matching portion 882 in the direction along which the terminal connecting pieces are inserted into the first accommodating cavities and the second accommodating cavities. The stop portions 92 are at least partially in blocking fit with the stopping front portions 881 of the terminal connecting pieces 88. In this embodiment, a second barb 48 is further provided in each of the first accommodating cavities 11 and the second accommodating cavities 12 respectively. The second barbs 48 are respectively in blocking fit with the blocking matching portions 882 of the terminal connecting pieces.

Embodiment VIII

Please refer to FIG. 16 to FIG. 20, which show a connecting assembly 107 provided by the present invention. The connecting assembly 107 includes any one of the connecting piece 101 of embodiment I and the connecting piece 103 of embodiment III, and the matched connecting piece 105 of embodiment VI.

Figure 17:
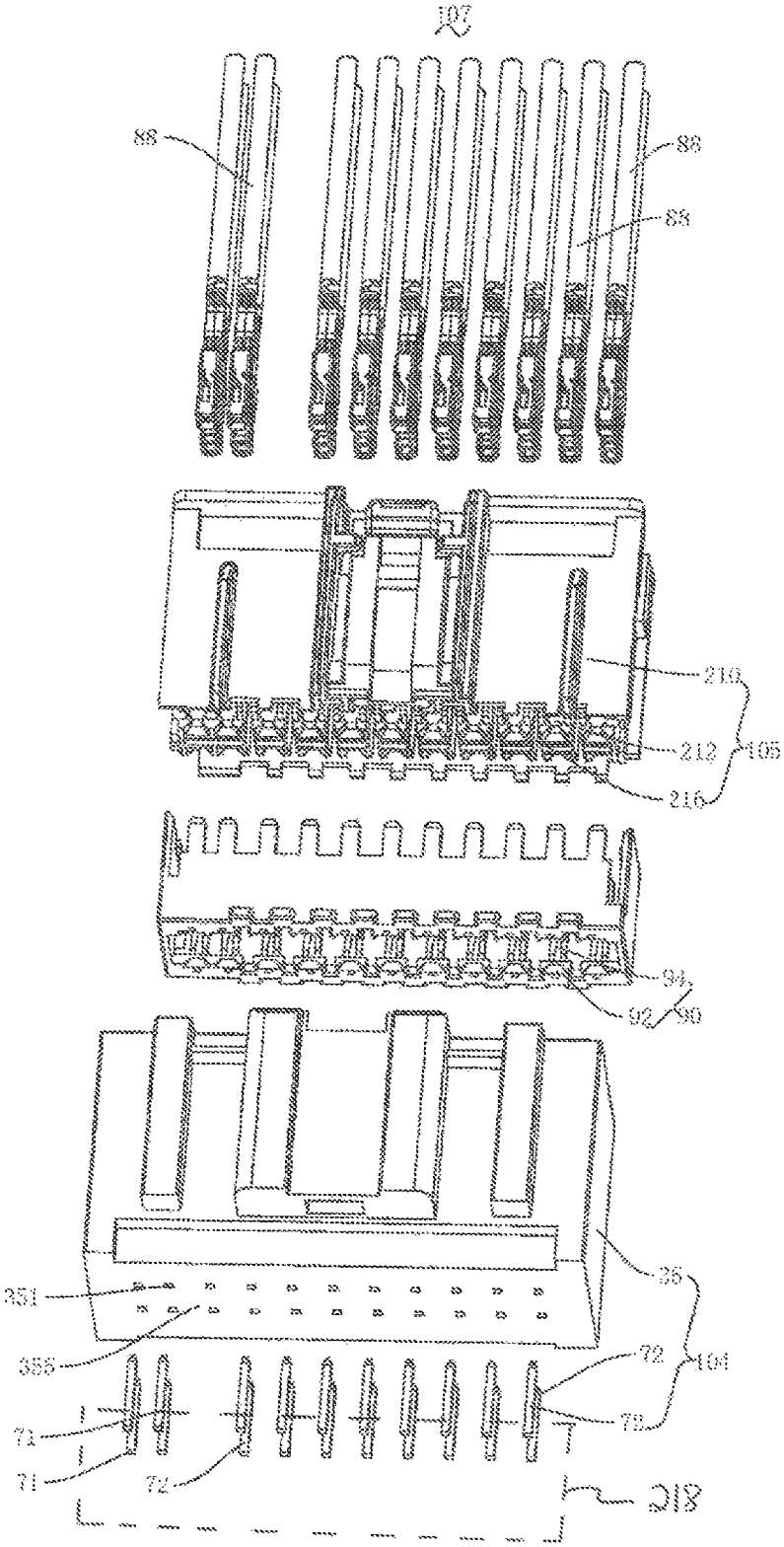
FIG. 17 is a perspective exploded view of the connecting assembly in FIG. 16 at one viewing angle.
Figure 18:
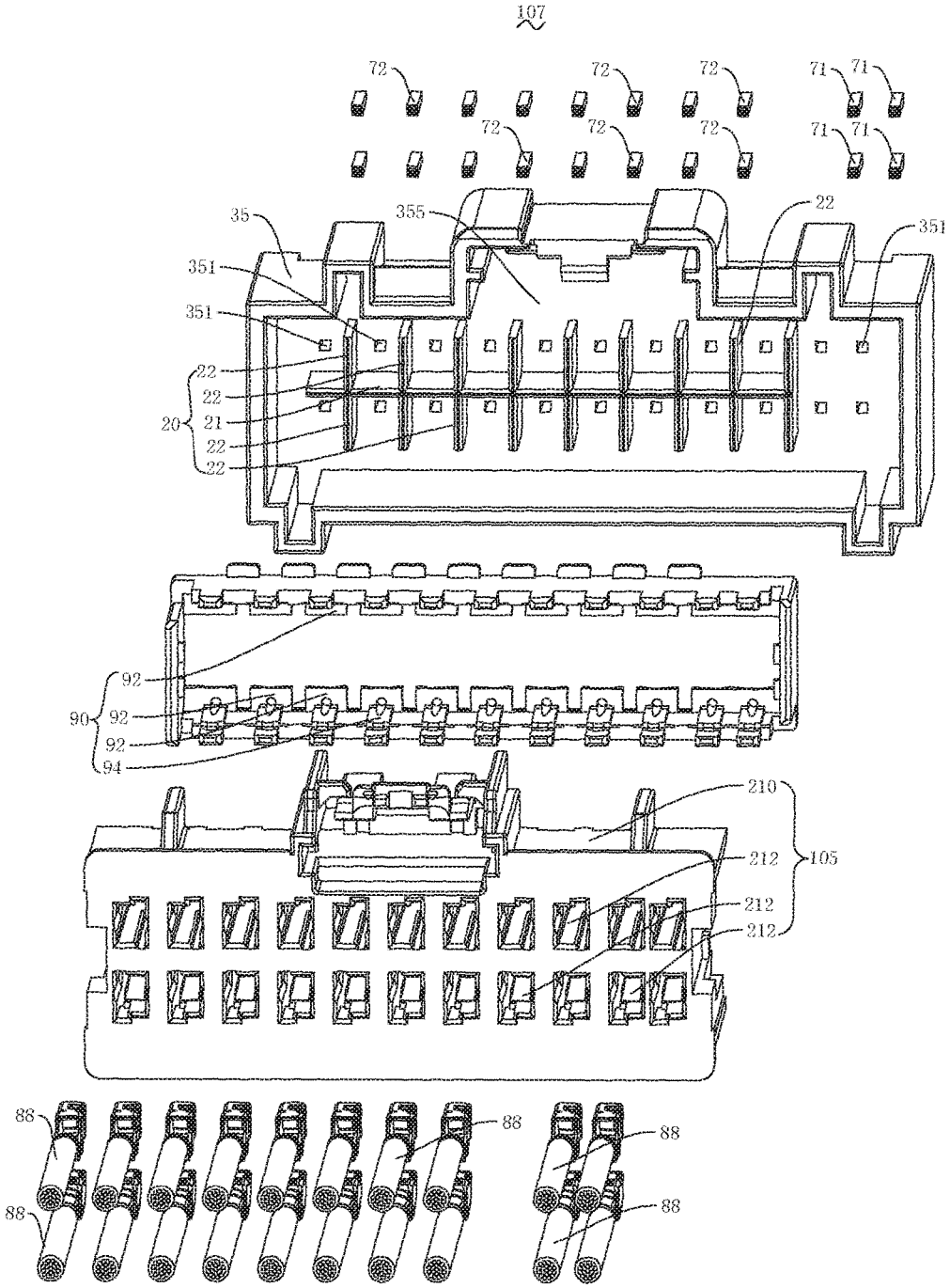
FIG. 18 is a perspective exploded view of the connecting assembly in FIG. 17 at another viewing angle.
Figure 19:
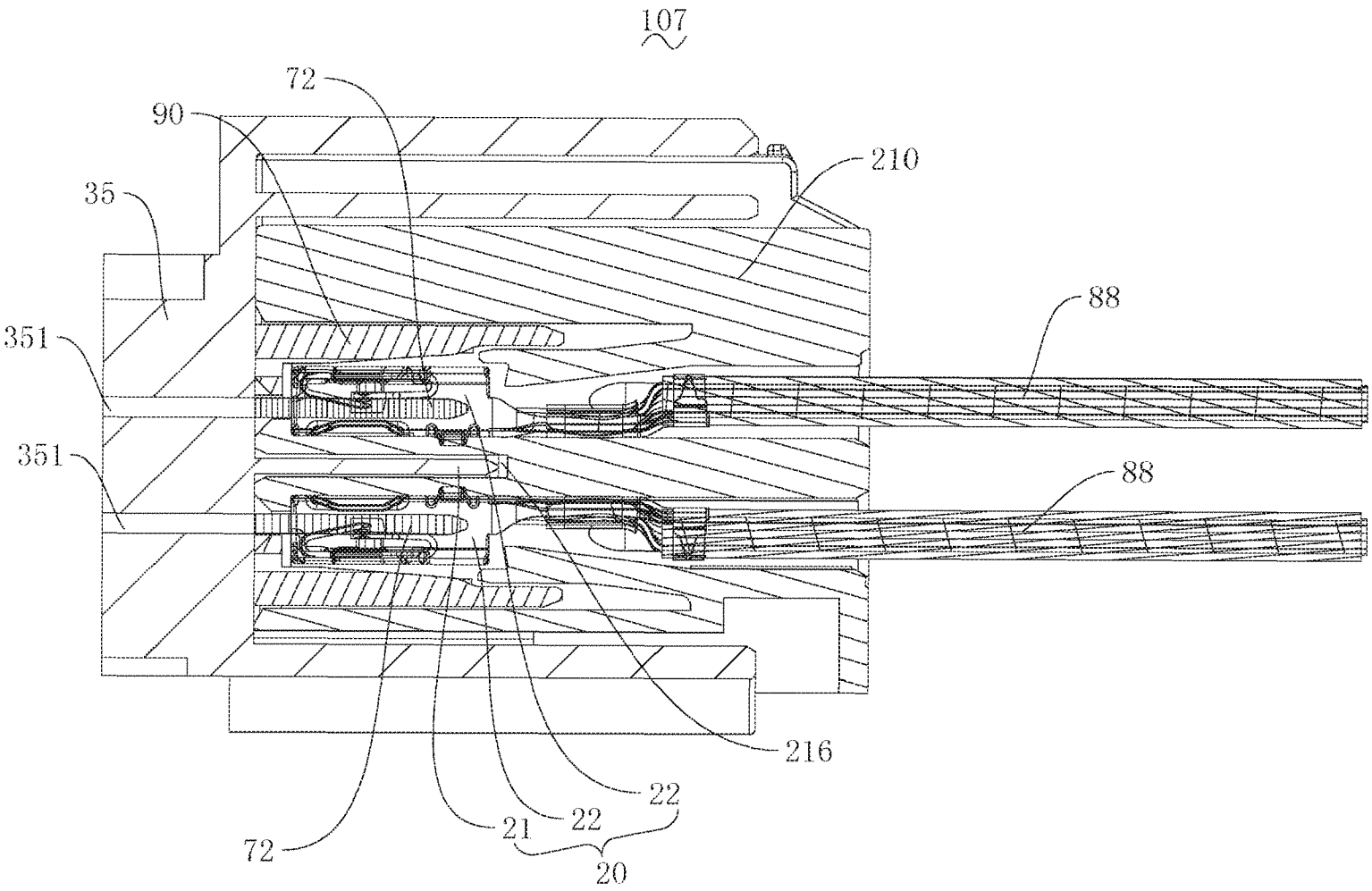
FIG. 19 is a section view of the connecting assembly in FIG. 16 along the line D-D.
Figure 20:
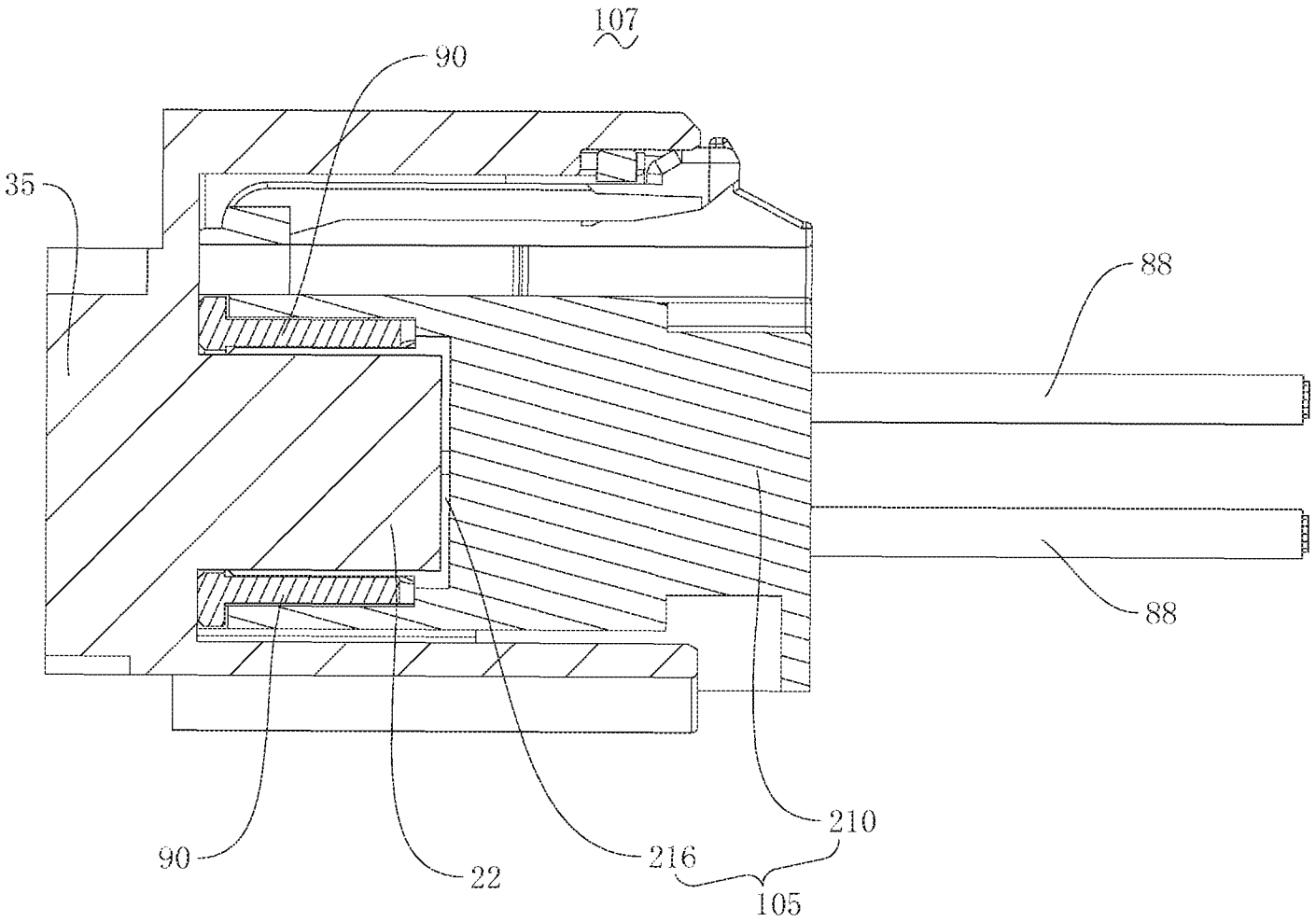
FIG. 20 is a section view of the connecting assembly in FIG. 16 along the line E-E.

The connecting assembly 107 may realize connection through wires. In this embodiment, to further achieve a stable electric connection, the connecting assembly 107 includes connecting terminals (40, 50, 71, 72). One end of each of the connecting terminals (40, 50, 71, 72) is arranged on the body 35, and the other end is inserted into the insertion hole 212. In order to improve the integration level of electronic devices, the connecting assembly 107 further includes a circuit board 218 (FIG. 17). One end of each of the connecting terminals (40, 50, 71, 72) is connected to the circuit board. In order to connect other devices, the connecting assembly 107 further includes terminal connecting pieces 88. The terminal connecting piece 88 is accommodated in the insertion hole 212 and connected with the other end of each of the connecting terminals (40, 50, 71, 72).

For the purpose of convenient description, just take the matching relationship between the connecting piece 103 of embodiment III and the matched connecting piece 105 of embodiment VI as an example to describe as follows: the connecting terminals (71, 72) are installed into the terminal accommodating cavities 351; then, the separators 20 are aligned with the isolating slots 216 of the matched connector 106; the connecting terminals (71, 72) of the connector 104 are inserted from the front ends of the insertion holes 212 to connect the terminal connecting pieces 88 inserted from the rear ends of the insertion holes 212.

Compared with the prior art, the connecting pieces (101, 103) of the present invention are provided with separators 20 on the bodies (10, 35) so that the connecting terminals (40, 50, 71, 72) inserted into the terminal accommodating cavities (11, 12, 351) on the bodies (10, 35) are separated, which improves the safe connection performance, enables all the connecting terminals (40, 50, 71, 72) to keep shorter spacing on the premise of no mutual interference, and enables the connecting pieces (101, 103) to be compact in overall structure and to reduce the installation space.

Preferably, via the transverse separators 21 matching with the longitudinal separators 22, the separators 20 of the connecting pieces (101, 103) not only improve the safety performance of the connecting pieces (101, 103) including a plurality of connecting terminals (40, 50, 71, 72), but also provide larger accommodating space for installing the connecting terminals with different specifications. The connecting pieces (101, 103) achieve a quick and convenience insertion, provide different connection manners, and can be matched with the matched connecting piece 105 to meet different connection requirements.

The foregoing descriptions are merely preferred embodiments of the present invention, but are not intended to limit the protection scope of the present invention. Any modification, equivalent substitution or improvement or the like made within the spirit of the present invention shall fall into the scope of the claims of the present invention.

What is claimed is:

1. A connector, comprising:

a body comprising a terminal fixing portion which is provided with a plurality of terminal accommodating cavities in a penetrating mode;

connecting terminals accommodated in the terminal accommodating cavities, wherein the connecting terminals extend out of the terminal accommodating cavities in an extension direction from the front end of the terminal fixing portion; and separators arranged on the body and positioned between the adjacent terminal accommodating cavities, wherein the separators extend reversely in the extension direction of the terminal accommodating cavities to separate the connecting terminals on two sides of each separator;

wherein lengths of the connecting terminals extending out of the terminal accommodating cavities are smaller than extension lengths of the adjacent separators.

2. The connector of claim 1, wherein the body comprises enclosure walls which continuously extend from the terminal fixing portion in an axial direction of the terminal accommodating cavities; and wherein the separators are spaced from the enclosure walls.

3. The connector of claim 1, wherein the terminal accommodating cavities are arranged in two rows, each row comprising a plurality of terminal accommodating cavities, and wherein the separators are arranged between all the adjacent terminal accommodating cavities.

4. The connector of claim 3, wherein the separators comprise a transverse separator and longitudinal separators; the transverse separator is arranged between one row of terminal accommodating cavities and the other row of terminal accommodating cavities; and wherein the longitudinal separators are arranged on two sides of each terminal accommodating cavity in each row.

5. The connector of claim 4, wherein all the longitudinal separators are connected with the transverse separator.

6. The connector of claim 1, wherein the terminal accommodating cavities comprise first accommodating cavities and second accommodating cavities, the first accommodating cavities used for accommodating low-voltage connecting terminals, and the second accommodating cavities used for accommodating high-voltage connecting terminals; and wherein the first accommodating cavities and the second accommodating cavities have the same dimension, shape and structure.

7. The connector of claim 1, wherein the terminal accommodating cavities comprise first accommodating cavities for accommodating low-voltage connecting terminals and second accommodating cavities for accommodating high-voltage connecting terminals; and wherein the separator is arranged between at least two adjacent second accommodating cavities.

8. The connector of claim 1, wherein the terminal accommodating cavities comprise first accommodating cavities and second accommodating cavities, the first accommodating cavities used for accommodating low-voltage connecting terminals, and the second accommodating cavities used for accommodating high-voltage connecting terminals; and wherein the separators are merely arranged between all the adjacent second accommodating cavities.

9. The connector of claim 1, wherein the connector further comprises first secondary locks; wherein each first secondary lock is provided with a blocking portion; wherein the first secondary locks are arranged on the body, and wherein the blocking portions are in blocking fit with the connecting terminals.

10. The connector of claim 1, wherein the connector further comprises a circuit board, wherein one end of each connecting terminal is connected to a matched terminal in a matched connector and the other end is connected to the circuit board.

11. The connector of claim 1, wherein the connecting terminals comprise low-voltage connecting terminals and high-voltage connecting terminals.

12. The connector of claim 11, wherein the low-voltage connecting terminals and the high-voltage connecting terminals have the same dimension, shape and structure.

13. A connector, comprising:

a body comprising a terminal fixing portion, which is formed with first accommodating cavities and second accommodating cavities, the first accommodating cavities being adapted to accommodate low-voltage connecting terminals, and the second accommodating cavities being adapted to accommodate high-voltage connecting terminals;

separators arranged on the body and positioned between the adjacent terminal accommodating cavities, and connecting terminals accommodated in the accommodating cavities, the connecting terminals extending out of the accommodating cavities from the front end of the terminal fixing portion, and with lengths of the connecting terminals extending out of the accommodating cavities being smaller than extension lengths of the adjacent separators;

wherein the separators extend reversely in the extension direction of the terminal accommodating cavities to separate the connecting terminals on two sides of each separator;

wherein the first accommodating cavities and the second accommodating cavities are in a penetrating mode and have the same dimension, shape and structure.

14. The connector of claim 13, wherein the body comprises enclosure walls which continuously extend from the terminal fixing portion in an axial direction of the terminal accommodating cavities; and wherein the separators are spaced from the enclosure walls.

15. The connector of claim 13, wherein the separators comprise a transverse separator and longitudinal separators; the transverse separator is arranged between one row of terminal accommodating cavities and the other row of terminal accommodating cavities; and wherein the longitudinal separators are arranged on two sides of each terminal accommodating cavity in each row.

16. The connector of claim 15, wherein all the longitudinal separators are connected with the transverse separator.

17. The connector of claim 13, wherein the terminal accommodating cavities comprise first accommodating cavities for accommodating low-voltage connecting terminals and second accommodating cavities for accommodating high-voltage connecting terminals; and wherein the separator is arranged between at least two adjacent second accommodating cavities.

18. The connector of claim 13, wherein the connector further comprises first secondary locks; wherein each first secondary lock is provided with a blocking portion; wherein the first secondary locks are arranged on the body, and wherein the blocking portions are in blocking fit with the connecting terminals.

19. The connector of claim 13, wherein the connecting terminals comprise low-voltage connecting terminals and high-voltage connecting terminals.

20. The connector of claim 19, wherein the low-voltage connecting terminals and the high-voltage connecting terminals have the same dimension, shape and structure.

* * * * *